US011408233B2

(12) United States Patent
Knijpstra

(10) Patent No.: US 11,408,233 B2
(45) Date of Patent: Aug. 9, 2022

(54) ASSEMBLY AND METHOD FOR FORMING A MAST FOR GUIDING A DRILL DRIVE IN A HORIZONTAL DIRECTIONAL DRILLING MACHINE

(71) Applicant: Javelin Consultancy and Investment Limited, North Yorkshire (GB)

(72) Inventor: Hette Knijpstra, Terband-Heerenveen (NL)

(73) Assignee: Javelin Consultancy and Investment Limited, North Yorkshire (GB)

( * ) Notice: Subject to any disclaimer, the term of this patent is extended or adjusted under 35 U.S.C. 154(b) by 2 days.

(21) Appl. No.: 16/511,209

(22) Filed: Jul. 15, 2019

(65) Prior Publication Data

US 2020/0024909 A1 Jan. 23, 2020

(30) Foreign Application Priority Data

Jul. 17, 2018 (NL) ..... 2021324

(51) Int. Cl.
*E21B 15/04* (2006.01)
*E21B 7/04* (2006.01)

(52) U.S. Cl.
CPC ..... *E21B 15/04* (2013.01); *E21B 7/046* (2013.01)

(58) Field of Classification Search
CPC ..... E21B 15/04; E21B 7/046; E21B 7/024
See application file for complete search history.

(56) References Cited

U.S. PATENT DOCUMENTS 2,075,185 A * 3/1937 Eiler ..... E21B 15/04 173/190
3,867,989 A * 2/1975 Hisey ..... E21B 7/021 173/147
4,134,237 A * 1/1979 Armstrong ..... E04H 12/182 52/118
7,255,406 B1 8/2007 Huck
10,662,720 B2 * 5/2020 Wurster ..... E21B 7/04

FOREIGN PATENT DOCUMENTS

DE 10206646 C1 7/2003
DE 102004019426 B3 11/2005

* cited by examiner

*Primary Examiner* — Jonathan Malikasim
(74) *Attorney, Agent, or Firm* — Michael Best & Friedrich LLP

(57) ABSTRACT

The invention relates to an assembly (1) for forming a mast for guiding a drill drive in an HDD machine. The assembly comprises a mast body (10) with a generally U-shaped cross-section, a mast cover with a recessed surface (21), a set of two or more racks (30), first connecting means (24) for connecting the racks releasably to the mast cover and second connecting means (44) for connecting the racks releasably to the mast body. The racks together with the mast body and the mast cover in assembled state form a mast with a substantially closed contour.

19 Claims, 4 Drawing Sheets

ASSEMBLY AND METHOD FOR FORMING A MAST FOR GUIDING A DRILL DRIVE IN A HORIZONTAL DIRECTIONAL DRILLING MACHINE

The invention relates to the field of what is internationally known as horizontal directional drilling (HDD). HDD is a technique which is much applied for laying pipelines under rivers, canals and roads for the purpose of underground infrastructure, such as water pipes, telecommunication cables and electricity cables.

An HDD machine (internationally known as HDD rig) is equipped for this purpose with a mast with racks for guiding a drill drive for a drill pipe. In the relevant field such a mast is known with racks welded thereto. Applicant markets an alternative mast, which is provided with a manhole for mounting the racks on the mast with bolts.

The present invention relates to an assembly for forming a mast for guiding a drill drive in an HDD machine, which assembly comprises:

a mast body with a generally U-shaped cross-section;

a mast cover with a recessed surface;

a set of two or more racks;

first connecting means for connecting the racks releasably to the mast cover;

and second connecting means for connecting the racks releasably to the mast body, wherein the racks together with the mast body and the mast cover in assembled state form a mast with a closed contour.

The present invention also relates to a method for forming the mast from an assembly according to the invention, which method comprises the following steps of:

a) mounting the racks on the mast cover;

b) placing the mast cover and the racks on the mast body; and c) mounting the racks on the mast body.

The assembly and the method according to the invention make it possible to assemble the mast from carefully selected components and materials and at any desired location. The racks, which are wear parts, can in particular be replaced faster and under better working conditions. This is because it is no longer necessary to mount them from the inside, and the manhole can be dispensed with. As a result, the mast can also take a more compact form.

In a first preferred embodiment the mast body is provided with support surfaces for the racks. The support surfaces simplify the mounting of the mast considerably.

According to a further development of the first preferred embodiment, the mast body is provided with bent edges which form the support surfaces. These bent edges form integrated support surfaces which enable integral production in advantageous manner.

In an optimal development of the first preferred embodiment the assembly further comprises a set of two or more strengthening strips for placing against the support surfaces. The strengthening strips support the racks and increase the loadability of the mast. The strengthening strips moreover enable a choice of different materials for the racks and the mast body.

In a practical preferred embodiment the first and/or the second connecting means are bolts.

According to a first preferred embodiment, the method according to the invention further comprises the step of selecting an assembly with strengthening strips, wherein step c) comprises the following sub-steps of:

c1) placing the strengthening strips against the support edges;

c2) connecting the racks to the support edges and the strengthening strips.

According to an optimal development of the first preferred embodiment of the method, step a) further comprises of placing a plurality of racks adjacently on one or both longitudinal sides of the mast cover and step c) comprises of connecting the strengthening strips to the support edges such that in assembled state of the mast one or more of the strengthening strips overlap the adjacent racks. The racks and the strengthening strips thereby come to lie in brick bond pattern, which will result in a better load distribution during use of the mast.

The invention also relates to a mast formed from the assembly according to the invention or by the method according to the invention.

The invention will be further elucidated with reference to the following figures, in which.

The same components are designated in the figures with the same numerals.

Figure 1:
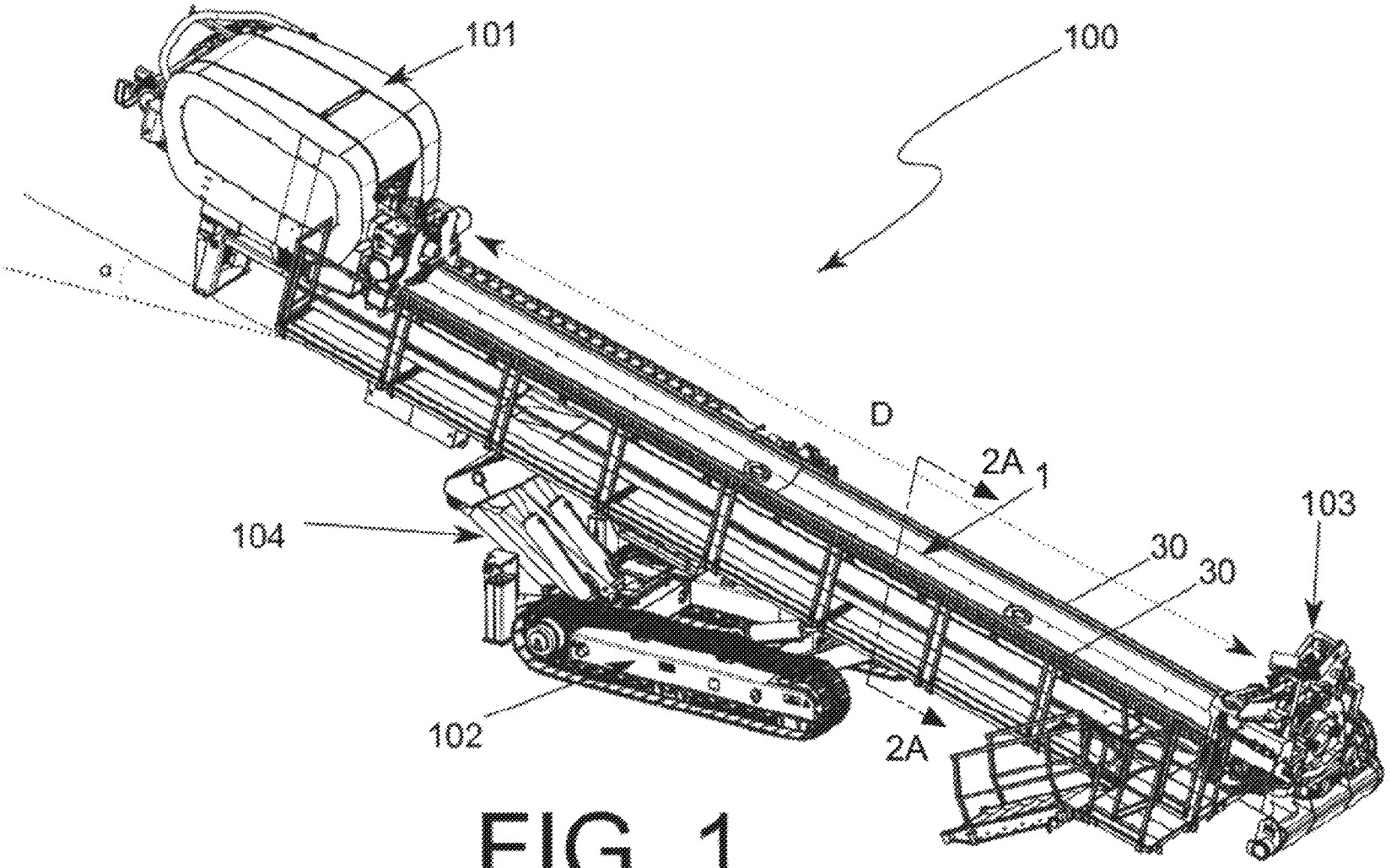
FIG. 1 shows an isometric view of an HDD rig provided with a mast assembled according to the invention.

FIG. 1 shows an isometric view of an HDD rig 100. HDD rig 100 is used for installing underground infrastructure. HDD rig 100 comprises at least a drill drive 101, a mast 1, an HDD rig drive 102, a drill pipe key 103 and mast angle adjusting means 104. HDD rig drive 102 comprises transport means for displacing HDD rig 100 in the field. Mast 1 is connected tiltably on HDD rig 100, wherein tilt angle $\alpha$ is adjustable by the mast angle adjusting means 104.

Drill drive 101 is displaceable from a first outer end of mast 1 over a distance D of the upper side of mast 1. Mast 1 is for this purpose provided on both longitudinal sides with racks 30, which co-act with pinions (not shown) in drill drive 101.

Placed at a second outer end of mast 1 is a drill pipe key 103 which during operation supports, secures (makes up) and releases (breaks up) a drill driven by drill drive 101 and consisting of a plurality of drill pipes. The drill pipe key is likewise displaceable over mast 1 by means of the racks.

Mast 1 is assembled by means of the assembly according to the invention.

Figure 2A:
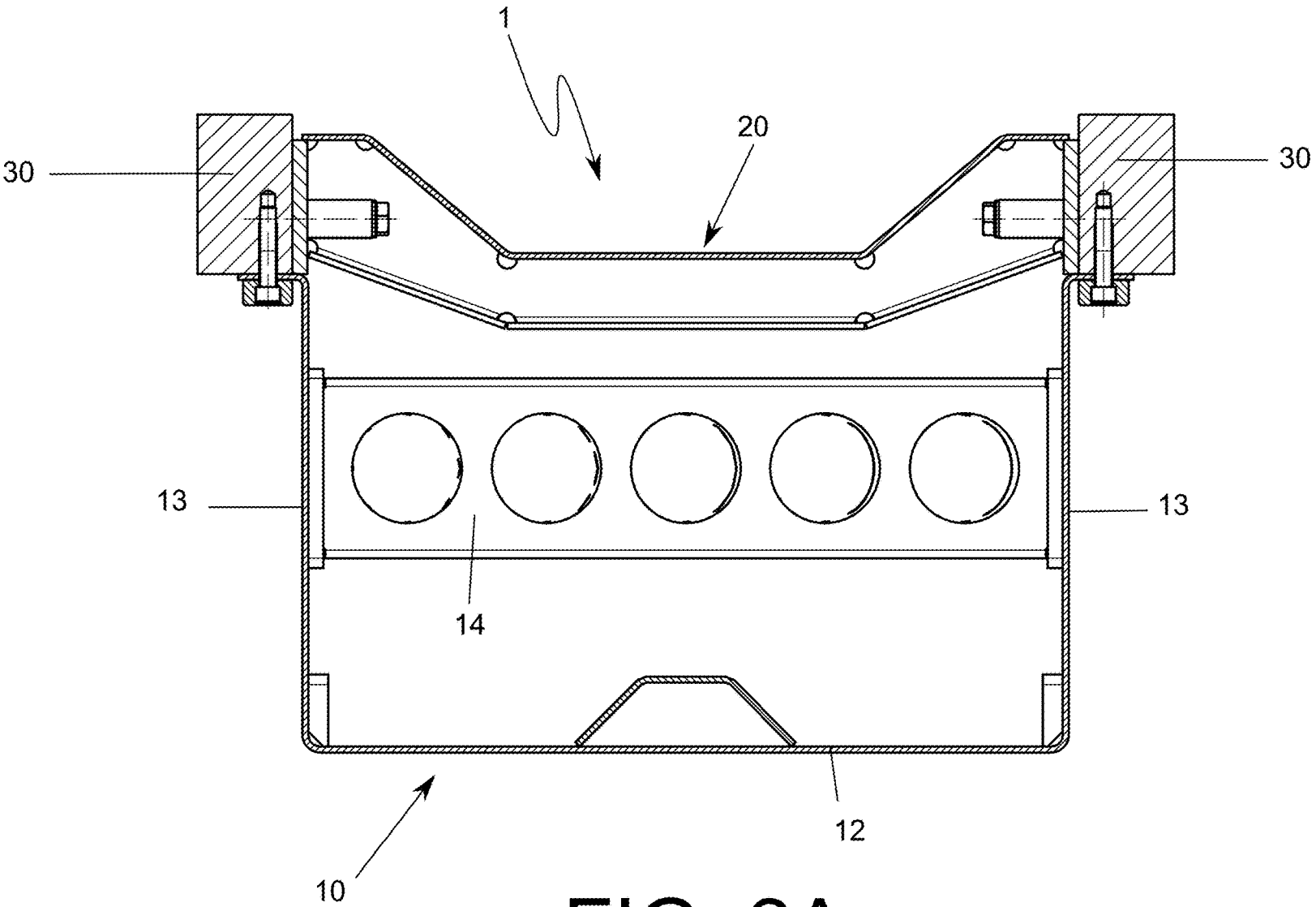
FIG. 2A shows a cross-section of the mast of FIG. 1.

FIG. 2A shows a cross-section of the mast 1 assembled by means of the assembly according to the invention. The assembly comprises a metal mast body 10 with a generally U-shaped cross-section, which is formed by a bottom 12 and first and second walls 13 standing upright from the bottom. Bottom 12 and walls 13 are preferably manufactured from one metal plate.

For strengthening purposes a plurality of metal bridges 14 are arranged between the first and second walls 13, which are preferably welded to the walls.

The assembly further comprises a mast cover 20 which forms the upper side of mast 1.

Mast body 10 and mast cover 20 are mutually connected by means of racks 30, which extends along both longitudinal sides of mast 1. Each rack is here connected to both mast body 10 and mast cover 20.

Figure 2B:
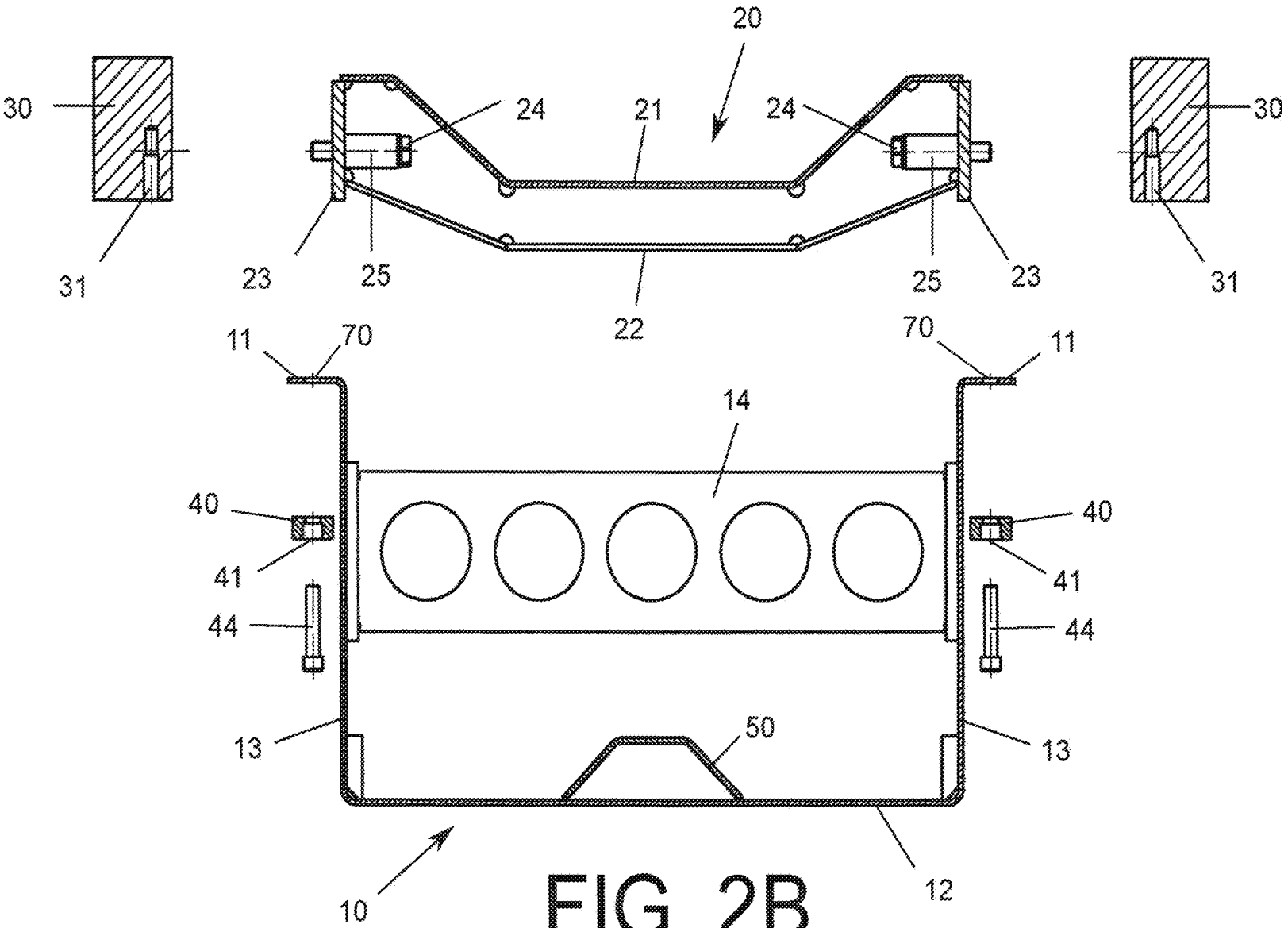
FIG. 2B shows an exploded view of mast 1 of FIG. 2A.

FIG. 2B shows an exploded view of the mast 1 in FIG. 2A.

Mast body 10 is provided on either side with support surfaces 11, which are preferably each formed by a bent edge 11 of mast wall 13. Support surfaces 11 are intended for placing of rack 30 on the upper side of mast body 10. Racks 30 are mounted with bolts 44, or equivalent second connecting means, on support surfaces 11 over the whole length of the racks. Racks 30 are provided for this purpose with a plurality of bolt holes 31. It will be evident that bent edge 11 has corresponding holes over the whole length. In order to absorb the load exerted by racks 30 on mast body 10 strengthening strips 40 are arranged on the underside of bent edges 11, which strips are connected by means of the bolts 44 to the edges 11. Strengthening strips 40 are for this purpose provided in the longitudinal direction with a plurality of bolt holes 41 which correspond to the bolt holes 31 and the corresponding holes 70 in edges 11.

For strengthening of mast 1 a tray-like beam 50 extending between the outer ends of mast 1 is preferably situated on bottom 12 on the inner side of mast body 10.

Mast cover 20 has a recessed upper side 21 which extends in longitudinal direction between the two outer ends of mast 1 and has a width which is smaller than or equal to the opening of U-shaped mast body 10.

For fastening of rack 30 to mast cover 20, mast cover 20 is in the shown preferred embodiment provided with sides 23 which are durably connected on a first longitudinal side to the recessed upper side 21. Sides 23 can be connected by means of filler bushings 25 and bolts 24 to rack 30 over the longitudinal direction of sides 23. Each rack 30 is provided for this purpose with corresponding bolt holes (not shown). The thickness of each side 23 is here greater than the thickness of the mast cover.

For strengthening purposes a plurality of plates 22, which connect sides 23 to each other, are arranged on the underside of mast cover 20 over the longitudinal direction of mast cover 20.

Figure 3:
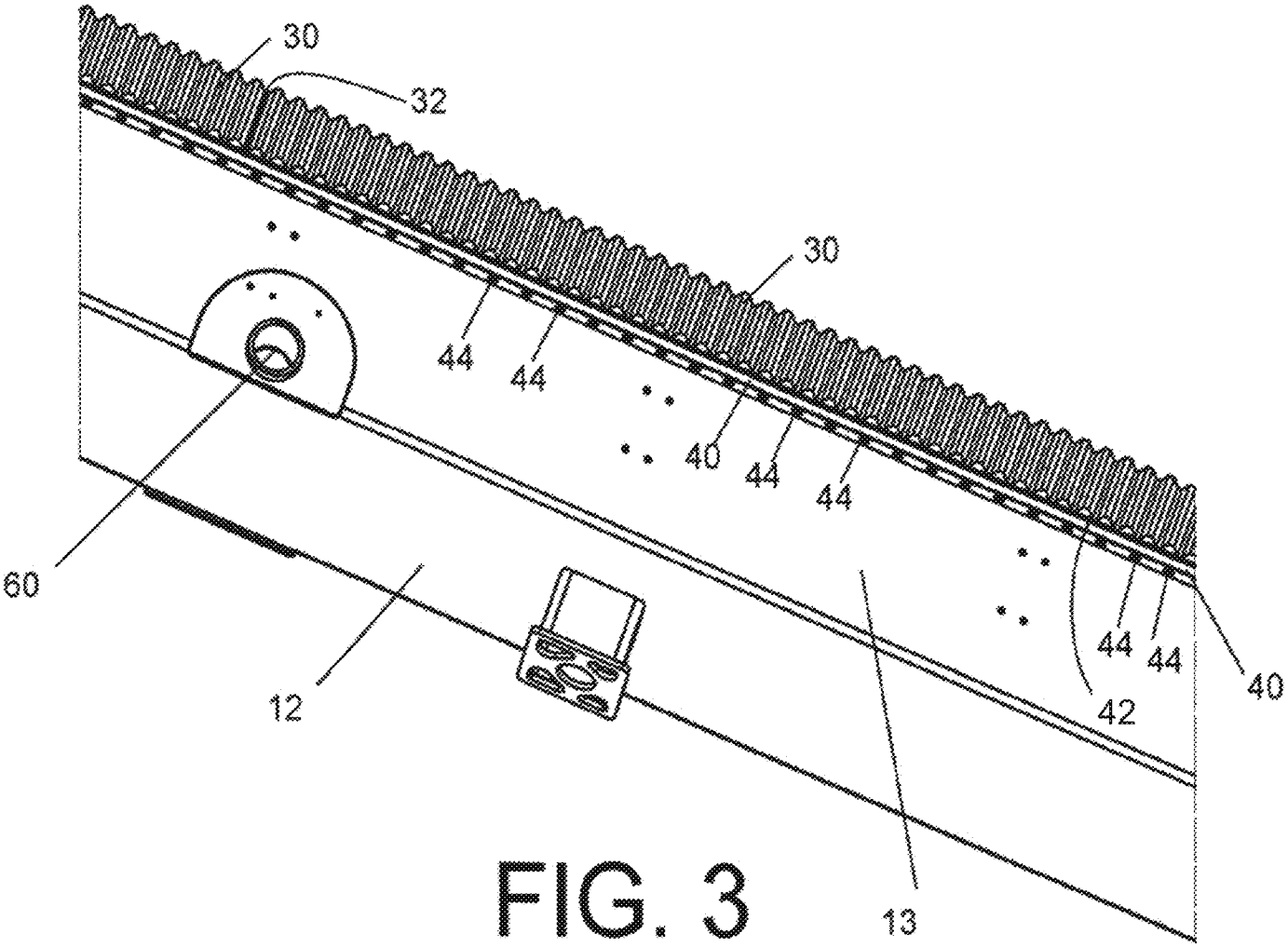
FIG. 3 shows a part of the mast of FIG. 1 in more detail.

FIG. 3 shows a detailed view of a side of mast 1 as seen from underside 12. Mast 1 is mounted on the HDD rig drive 102 by means of tilting shaft 60.

Depending on the length of mast 1, a plurality of racks 30 and a plurality of strengthening strips 40 are generally mounted adjacently over the longitudinal direction of each side of mast 1. They are preferably mounted on mast 1 in overlapping manner in order to ensure that no weak spots form in mast 1. The positions of the ends 32 of adjacent racks 30 and of the ends 42 of adjacent strengthening strips 40 are shown.

Mast 1 can optionally be constructed from a plurality of adjacent mast bodies 10 provided with a plurality of adjacent mast covers 20. Mast bodies 10 can here be connected to each other with additional connecting pieces, as can mast covers 20.

The method for forming the mast 1 for guiding a drill drive in an HDD machine of the assembly according to the invention comprises the following steps of:

a) connecting racks 30 to mast cover 20 by means of filler bushings 25 and bolts 24 over the longitudinal direction of sides 23;
b) placing mast cover 20 together with the mounted racks 30 on mast body 10; and
c) connecting racks 30 to mast body 10 by means of bolts 44 in bolt holes 31 via corresponding holes 70 in support surfaces 11 of mast body 10. Strengthening strips 40 are preferably also placed against the underside of the support edges, such that the holes 70 in support surfaces 11 correspond to the holes 41 in strengthening strips 40 and racks 30 are connected to support edges 11 and strengthening strips 40 after bolting.

Mast 1 according to FIG. 1 in many cases has a length such that it is desirable for a plurality of adjacent racks 30 to be applied on both longitudinal sides in the longitudinal direction of mast 1. In that case step a) further comprises of placing a plurality of racks 30 adjacently on both longitudinal sides of mast cover 20 and step c) comprises of connecting strengthening strips 40 to support edges 11 such that in assembled state of mast 1 one or more of the strengthening strips 40 overlap the adjacent racks 30.

The invention is of course not limited to the described and shown preferred embodiment, but extends to any embodiment falling within the scope of protection as defined in the claims and as seen in the light of the foregoing description and accompanying drawings.

The invention claimed is:

1. An assembly for forming a mast for guiding a drill drive in a horizontal direction drilling (HDD) machine, which assembly comprises:
   - a mast body extending between a first outer end and a second outer end with a generally U-shaped cross-section;
   - a mast cover having an upper side with a recessed surface extending substantially continuously in a longitudinal direction between the first outer end and the second outer end of the mast body, the upper side substantially closing the mast body, the recessed surface being recessed in a direction toward a bottom wall of the mast body;
   - a set of two or more racks having gear teeth configured to co-act with pinions;
   - a first set of fasteners releasably connecting the racks to the mast cover;
   - and a second set of fasteners releasably connecting the racks to the mast body.

2. The assembly according to claim 1, wherein the mast body is provided with support surfaces for the racks.

3. The assembly according to claim 2, wherein the mast body is provided with bent edges which form the support surfaces.

4. The assembly according to claim 2, wherein the assembly further comprises a set of two or more strengthening strips placed against the support surfaces.

5. The assembly according to claim 1, wherein the first set of fasteners are bolts.

6. The assembly according to claim 1, wherein the second set of fasteners are bolts.

7. The assembly according to claim 1, wherein the mast body includes the bottom wall and first and second side walls standing upright from the bottom wall to define the generally U-shaped cross-section.

8. The assembly according to claim 7, wherein the bottom wall and the first and second side walls are formed from a single metal plate.

9. The assembly according to claim 1, wherein the mast cover includes a first outer side coupled to a first lateral end of the upper side, and a second outer side coupled to a second lateral end of the upper side.

10. A method for forming a mast for guiding a drill drive in a horizontal direction drilling (HDD) machine from an assembly, which assembly comprises:
   - a mast body extending between a first outer end and a second outer end with a generally U-shaped cross-section;
   - a mast cover having an upper side with a recessed surface extending substantially continuously in a longitudinal direction between the first outer end and the second outer end of the mast body, the upper side substantially closing the mast body, the recessed surface being recessed in a direction toward a bottom wall of the mast body;

a set of two or more racks having gear teeth configured to co-act with pinions;

a first set of fasteners releasably connecting the racks to the mast cover;

and a second set of fasteners releasably connecting the racks to the mast body, which method comprises the following steps of:

a) connecting the racks to the mast cover;

b) placing the mast cover and the racks on the mast body; and c) connecting the racks to the mast body.

11. The method according to claim 10, wherein the method further comprises the step of selecting an assembly which further comprises a set of two or more strengthening strips for placing against the support surfaces, wherein step c) comprises the following sub-steps of:

c1) placing the strengthening strips against the support edges;

c2) connecting the racks to the support edges and the strengthening strips.

12. The method according to claim 11, wherein step a) further comprises of placing a plurality of racks adjacently on one or both longitudinal sides of the mast cover and wherein step c) comprises of connecting the strengthening strips to the support edges such that in assembled state of the mast one or more of the strengthening strips overlap the adjacent racks.

13. The method according to claim 10, wherein the mast body includes the bottom wall and first and second side walls standing upright from the bottom wall to define the generally U-shaped cross-section.

14. The method according to claim 13, wherein the bottom wall and the first and second side walls are formed from a single metal plate.

15. The method according to claim 10, wherein the mast cover includes a first outer side coupled to a first lateral end of the upper side, and a second outer side coupled to a second lateral end of the upper side.

16. A mast for guiding a drill drive in a horizontal direction drilling (HDD) machine, formed from an assembly comprising:

a mast body extending between a first outer end and a second outer end with a generally U-shaped cross-section;

a mast cover having an upper side extending substantially continuously in a longitudinal direction between the first outer end and the second outer end of the mast body, the upper side substantially closing the mast body;

a set of two or more racks having gear teeth configured to co-act with pinions;

a first set of fasteners releasably connecting the racks to the mast cover;

and a second set of fasteners releasably connecting the racks to the mast body.

17. The mast according to claim 16, wherein the mast body includes a bottom wall and first and second side walls standing upright from the bottom wall to define the generally U-shaped cross-section.

18. The mast according to claim 17, wherein the bottom wall and the first and second side walls are formed from a single metal plate.

19. The mast according to claim 16, wherein the mast cover includes a first outer side coupled to a first lateral end of the upper side, and a second outer side coupled to a second lateral end of the upper side.

* * * * *